US009611088B2

(12) United States Patent
Carmen

(10) Patent No.: US 9,611,088 B2
(45) Date of Patent: Apr. 4, 2017

(54) PAINT ROLLER AND PAINT BRUSH BAG DISPENSING SYSTEM

(71) Applicant: David A. Carmen, Plainfield, NJ (US)

(72) Inventor: David A. Carmen, Plainfield, NJ (US)

( * ) Notice: Subject to any disclaimer, the term of this patent is extended or adjusted under 35 U.S.C. 154(b) by 0 days.

(21) Appl. No.: 14/422,297

(22) PCT Filed: Aug. 23, 2013

(86) PCT No.: PCT/US2013/056357

§ 371 (c)(1),
(2) Date: Feb. 18, 2015

(87) PCT Pub. No.: WO2014/031940

PCT Pub. Date: Feb. 27, 2014

(65) Prior Publication Data

US 2015/0217932 A1 Aug. 6, 2015

Related U.S. Application Data

(60) Provisional application No. 61/692,576, filed on Aug. 23, 2012.

(51) Int. Cl.

| | |
|---|---|
| ***A46B 7/10*** | (2006.01) |
| ***B65D 85/671*** | (2006.01) |
| ***A46B 15/00*** | (2006.01) |
| ***B05C 17/02*** | (2006.01) |
| ***B65D 33/00*** | (2006.01) |

(52) U.S. Cl.

CPC ..... *B65D 85/671* (2013.01); *A46B 7/10* (2013.01); *A46B 15/0061* (2013.01); *B05C 17/0245* (2013.01); *B65D 33/002* (2013.01); *A46B 2200/202* (2013.01)

(58) Field of Classification Search

CPC ... A46B 15/0061; A46B 7/10; B05C 17/0245; B65D 85/671; B65D 33/002

See application file for complete search history.

(56) References Cited

U.S. PATENT DOCUMENTS 5,975,394 A * 11/1999 Shuval ..... B65D 33/002 225/106
6,003,669 A * 12/1999 Baricevic ..... B65D 33/002 206/408
6,210,768 B1 * 4/2001 Blok ..... B42D 5/003 206/389

(Continued)

*Primary Examiner* — Michael Jennings
(74) *Attorney, Agent, or Firm* — Global Intellectual Property Agency, LLC; Daniel Boudwin

(57) ABSTRACT

A paint roller and paint brush bag dispensing system for conveniently providing storage for bags to preserve or dispose of paint roller covers and paint brushes features a body with a body cavity located inside. The system includes a paint roller bag dispenser device, a paint roller cover, a paint roller cover frame with handle, a plastic bag roll, and an optional paint extension pole. A bag slot is located on a body side wall and is fluidly connected to the body cavity. A first male attachment is located on a body first end and a mated first female attachment is located on a body second end. The system features a roll of plastic bags attached to one another in the body cavity. A first end of the roll of plastic bags is placed through and extends from the bag slot for pulling out a bag and detaching it from the roll of plastic bags when needed.

11 Claims, 8 Drawing Sheets

(56) References Cited

U.S. PATENT DOCUMENTS

| | | | | |
|---|---|---|---|---|
| 2006/0054527 | A1* | 3/2006 | Hart | B44D 3/125 206/459.5 |
| 2007/0062823 | A1* | 3/2007 | Anderson | B44D 3/125 206/1.8 |
| 2008/0099596 | A1* | 5/2008 | DeMaso | A47K 10/3818 242/588.3 |
| 2011/0308193 | A1* | 12/2011 | Smith | B65D 85/671 52/741.4 |
| 2013/0193159 | A1* | 8/2013 | Cahalan | B65D 33/002 221/64 |
| 2013/0248554 | A1* | 9/2013 | Robin | B65F 1/0006 221/185 |

* cited by examiner

PAINT ROLLER AND PAINT BRUSH BAG DISPENSING SYSTEM

CROSS REFERENCE

This application claims priority to U.S. Provisional Patent Application No. 61/692,576, filed Aug. 23, 2012, the specification(s) of which is/are incorporated herein in their entirety by reference.

FIELD OF THE INVENTION

The present invention relates to paint equipment or more specifically, integrated paint roller bag dispensers for paint roller bags to store and dispose of paint roller covers and paintbrushes.

BACKGROUND OF THE INVENTION

Washing paint brushes and paint roller covers after a painting job can be messy, time consuming and not entirely effective. During this process, an individual may leave the wafer running, leading to wastefulness. Even when spending considerable amount of time washing the brush or roller cover, the bristles or nap might still be partially laden with paint. If the paint is not washed perfectly clean from the brush or roller cover, dried residue might compromise the quality of the next project. Brush and roller covers can be used to keep the brushes and roller covers moist between used. The present invention features a paint roller and paint brush bag dispensing system for conveniently providing storage for bags to preserve or dispose of paint roller covers and paint brushes.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a paint roller and paint brush bag dispensing system for conveniently providing storage for bags to preserve or dispose of paint roller covers and paint brushes. In some embodiments, the system comprises a body having a body first end, an opposing body second end, and a body cavity located inside. In some embodiments, a slot is located on a body side wall and is fluidly connected to the body cavity. In some embodiments, a first male attachment is located on the body first end and a mated first female attachment is located on the body second end.

In some embodiments, the system comprises a roll of plastic bags attached to one another. In some embodiments, the roll of plastic bags is located in the body cavity. In some embodiments, a first end of the roll of plastic bags is placed through and extends from the body slot for pulling out a bag and detaching it from the roll of plastic bags when needed.

In some embodiments, the first male attachment is located on the body is designed to attach to a second female attachment located on a paint roller handle. In some embodiments, the first female attachment located on the body is designed to attach to the second male attachment located on a paint roller handle extension.

DESCRIPTION OF PREFERRED EMBODIMENTS

Figure 1:
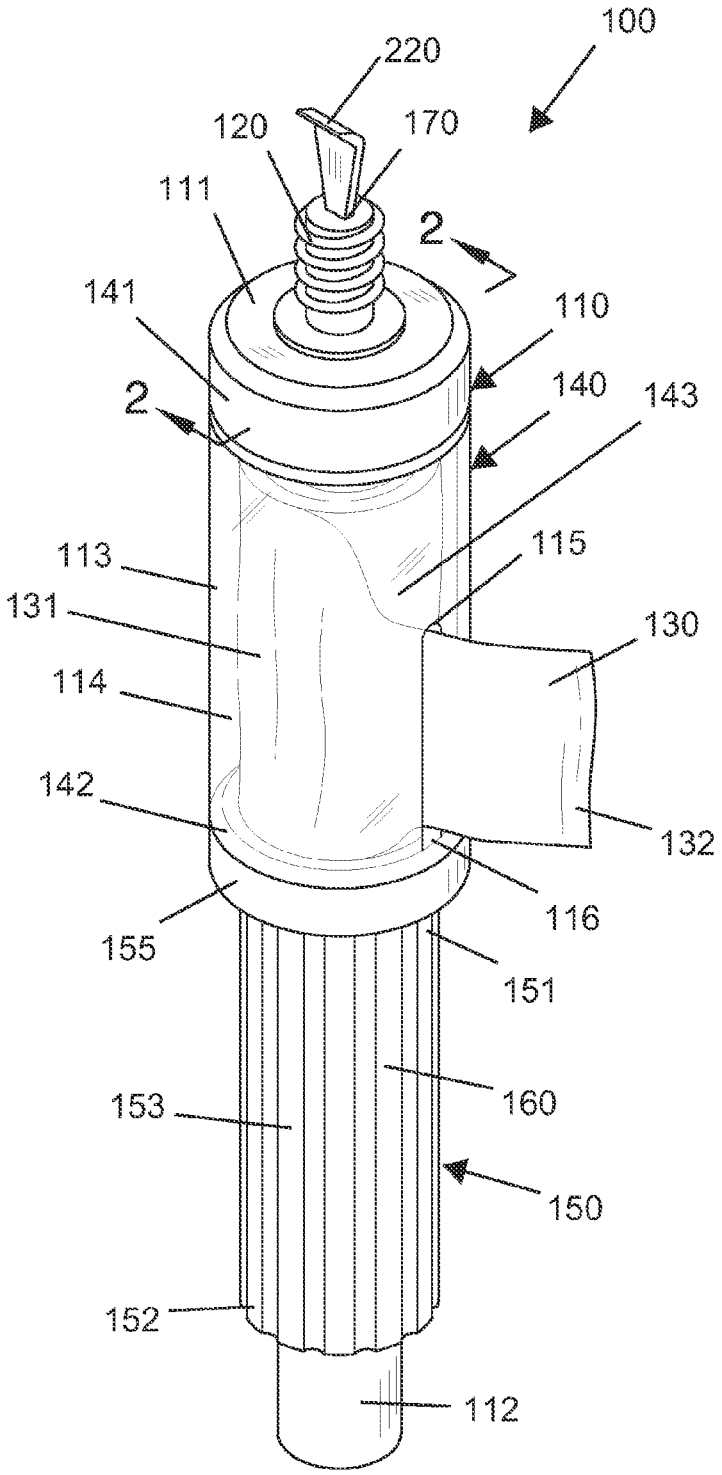
FIG. 1 shows a perspective view of the present invention.
Figure 2:
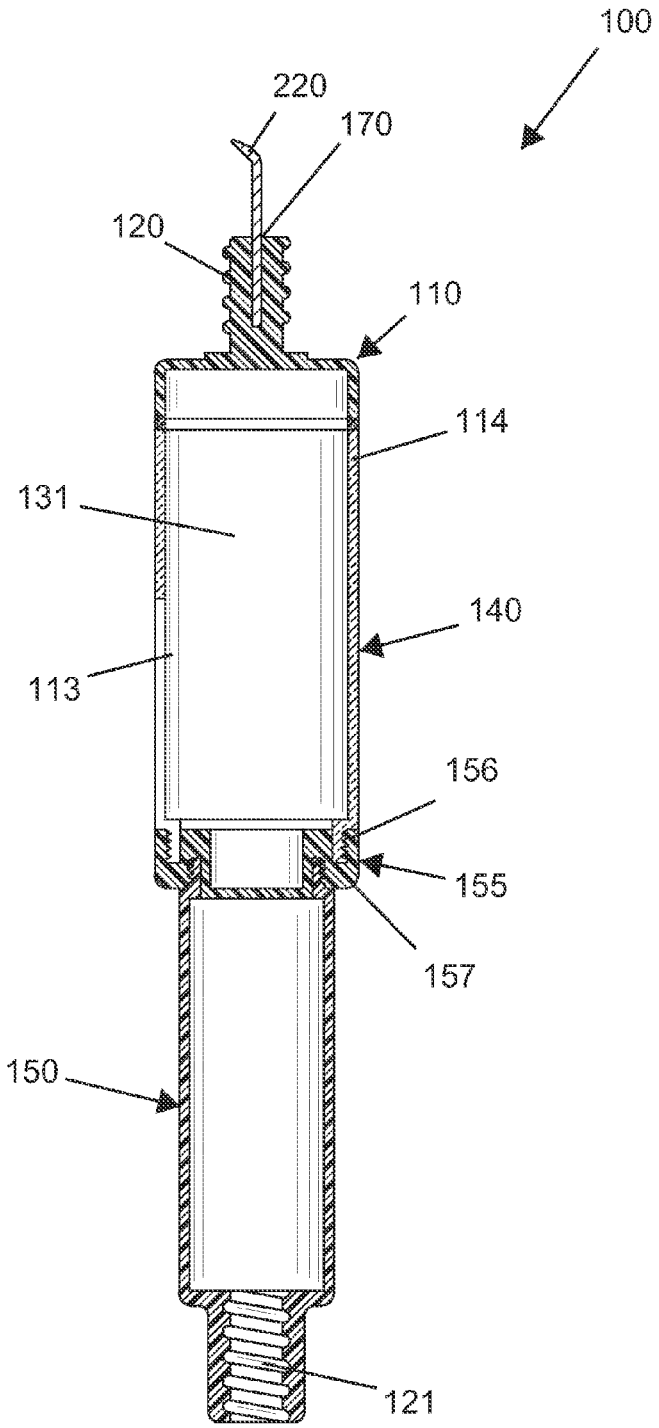
FIG. 2 shows a cross-sectional view of the present invention.
Figure 3:
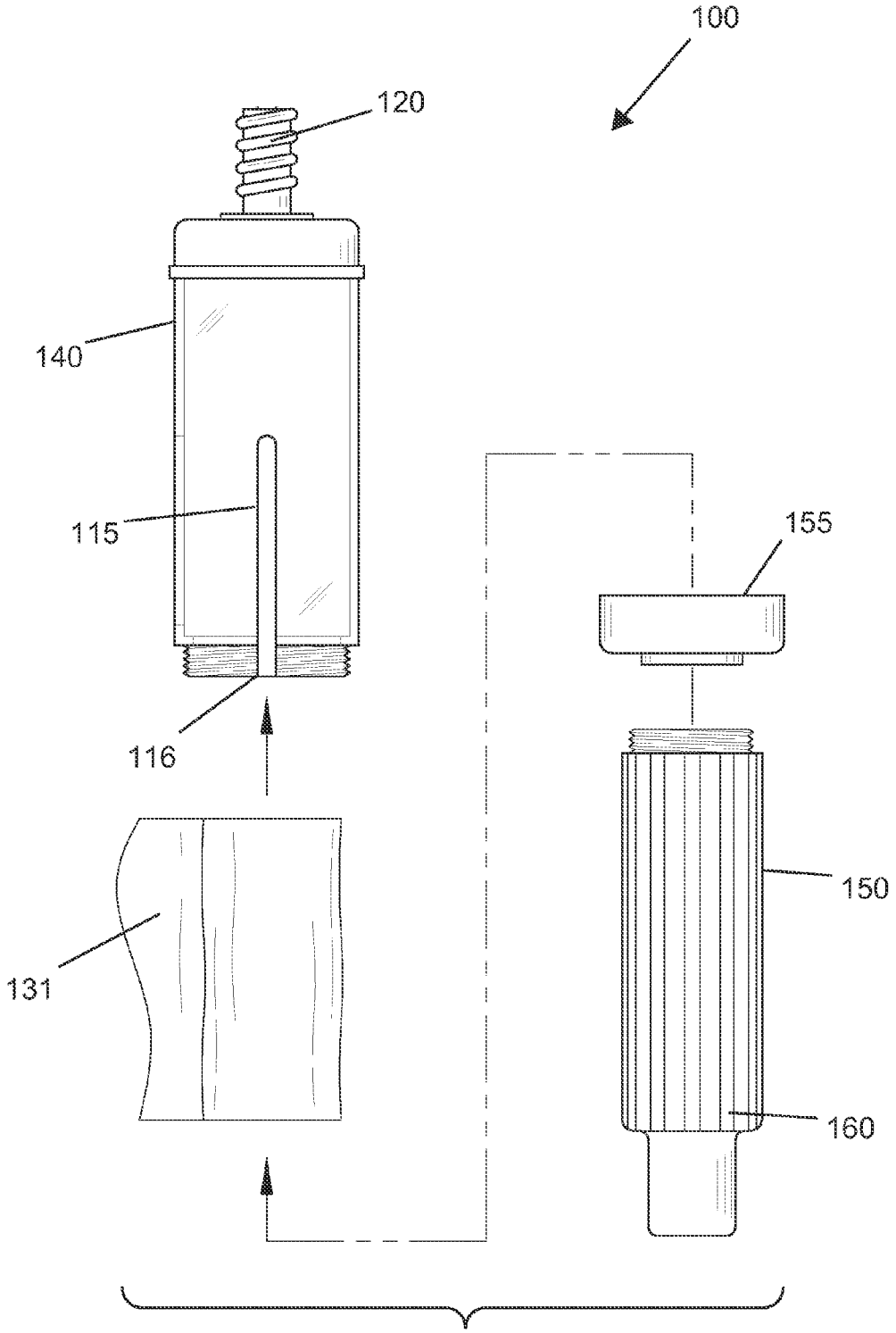
FIG. 3 shows a side view of the anterior body member, a roll of plastic bags, and a posterior body member of the present invention.
Figure 4:
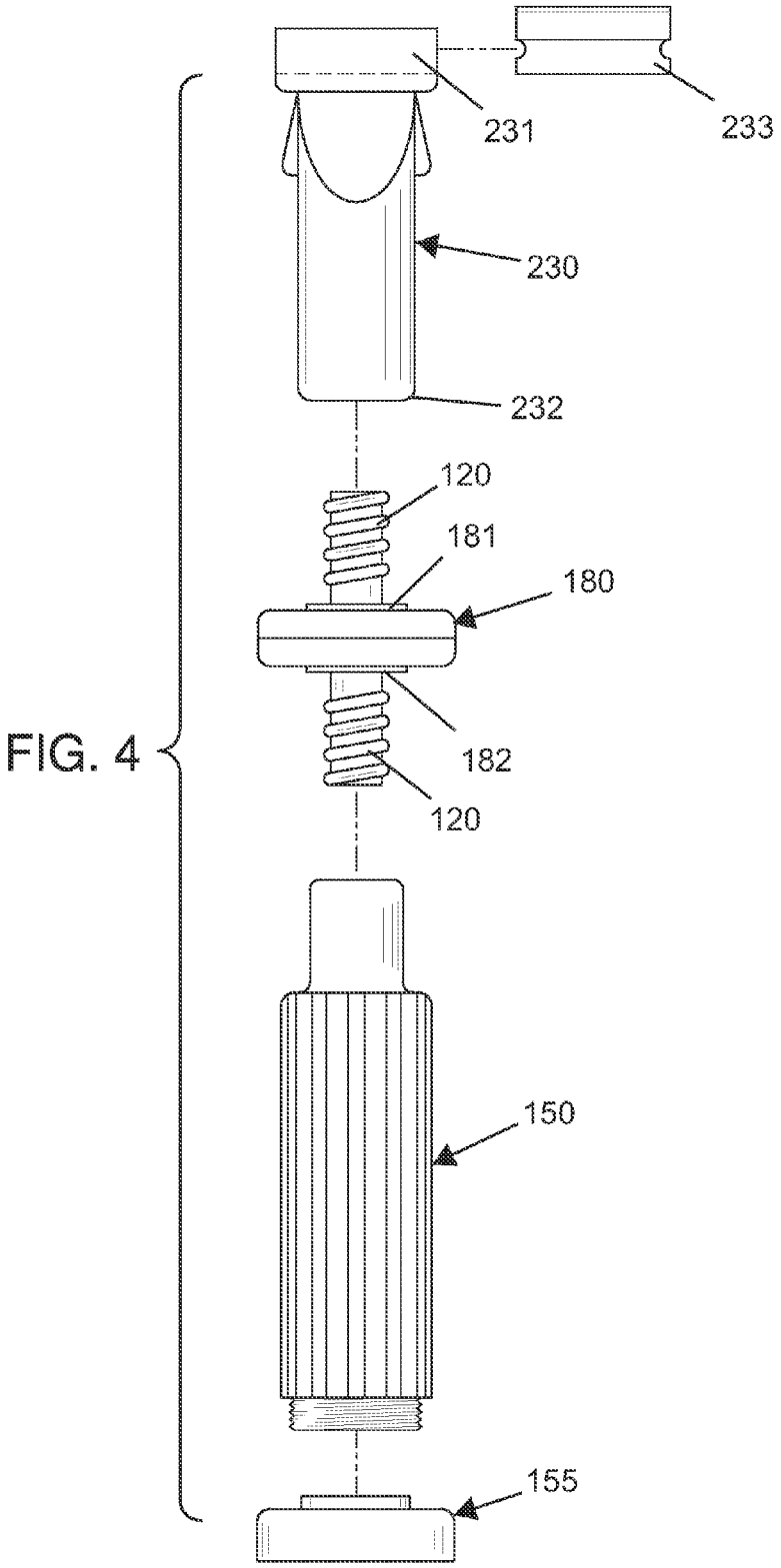
FIG. 4 shows a side view of an alternate embodiment of the present invention featuring a razor attachment.
Figure 5:
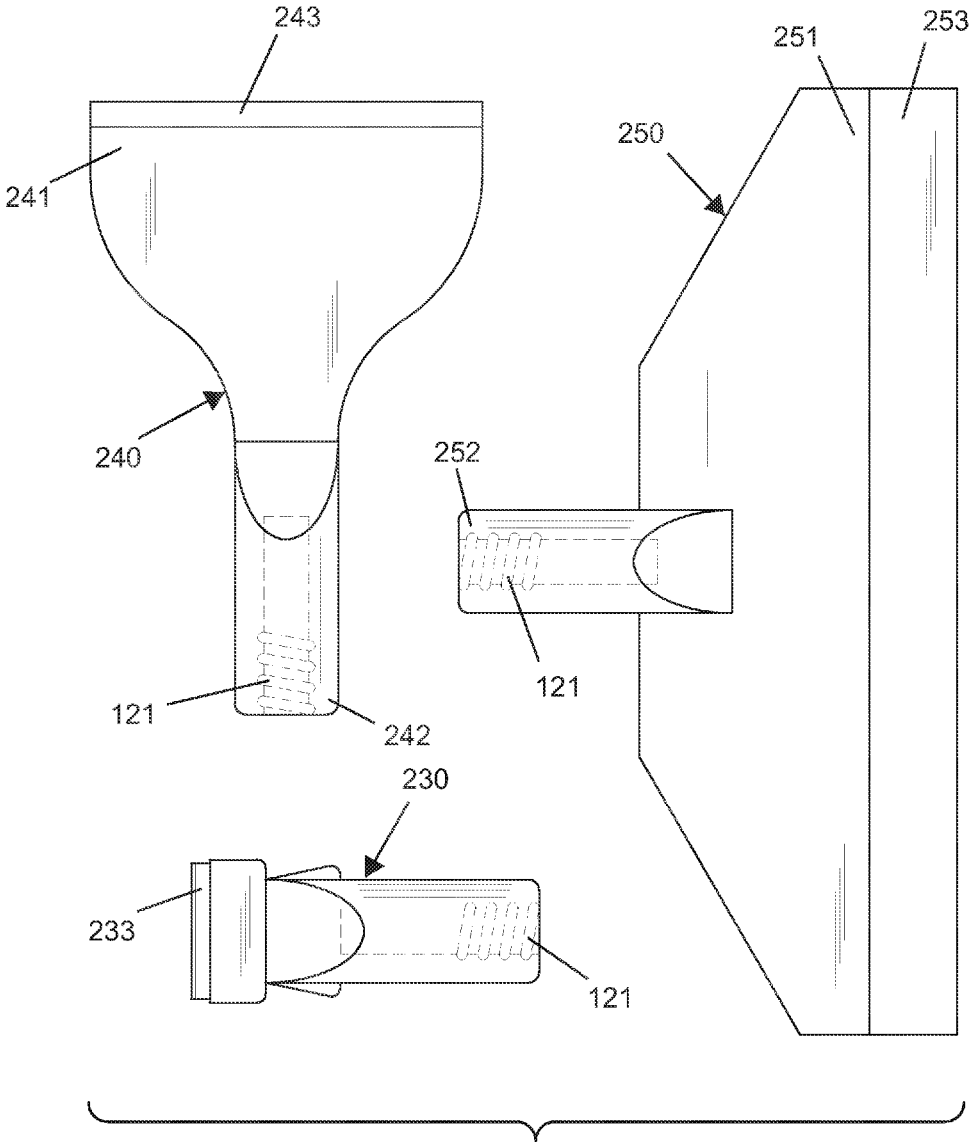
FIG. 5 shows a side view of the razor attachment, a scraper attachment, and a trim guide attachment of the present invention.
Figure 6:
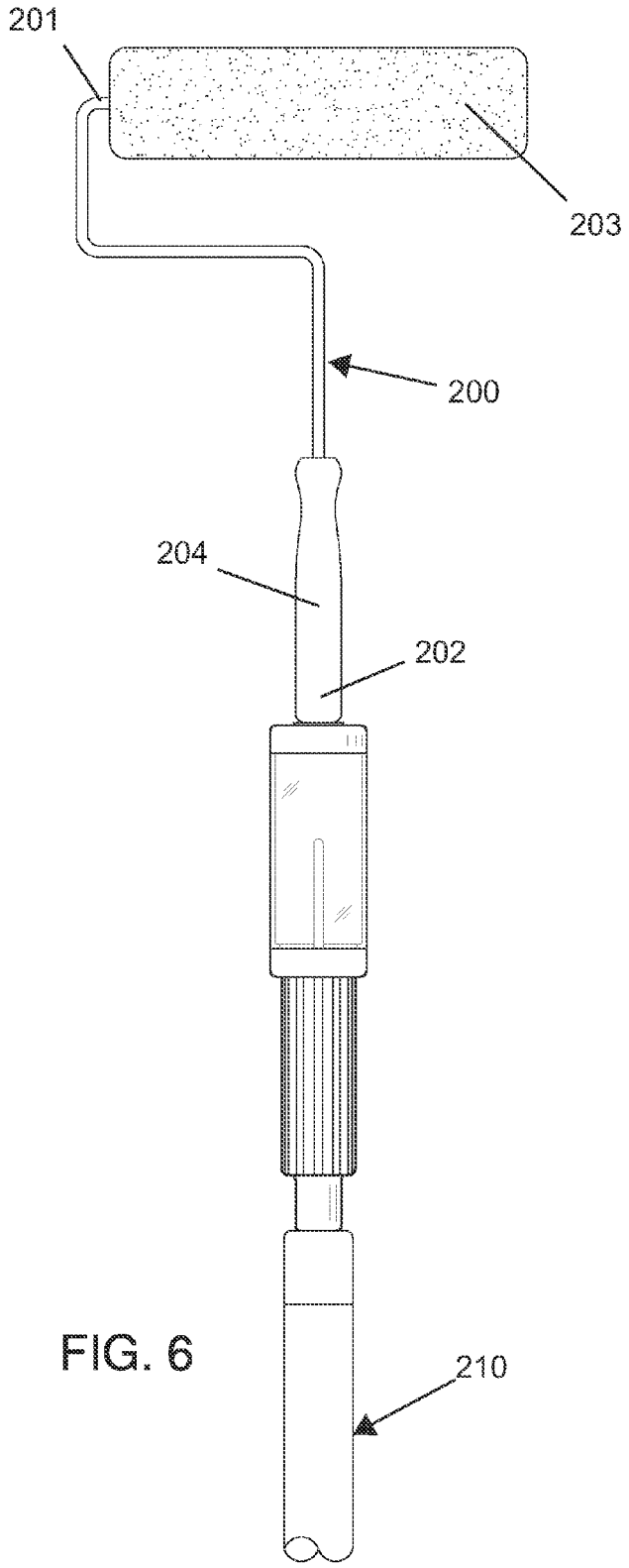
FIG. 6 shows a side view of the present invention featuring a paint roller.
Figure 7:
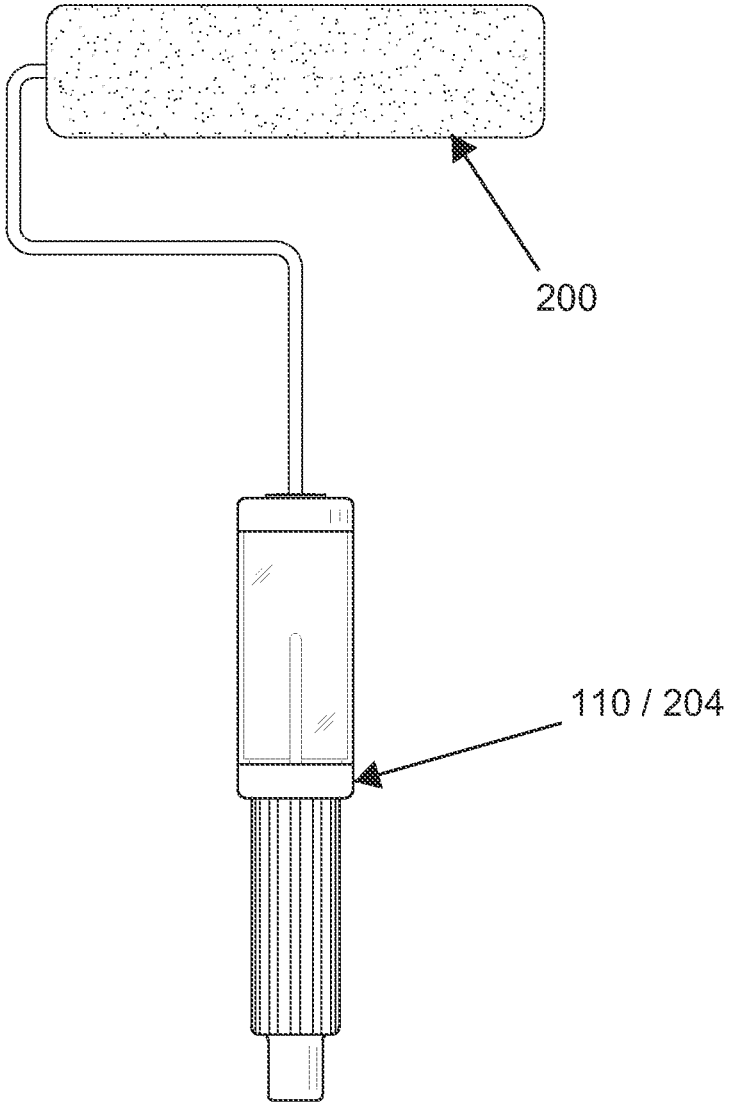
FIG. 7 shows a side view of an alternate embodiment of the present invention.

Following is a list of elements corresponding to a particular element referred to herein:

100 Bag dispensing system
110 Body
111 Body first end
112 Body second end
113 Body cavity
114 Body side wall
115 Bag slot
116 Slot second end
120 Male attachment
121 Female attachment
130 Plastic bag
131 Roll of plastic bags
132 Roll of plastic bags first outer end
140 Anterior body member
141 Anterior body member first end
142 Anterior body member second end
143 Anterior body member midsection
144 Thin plastic tubular component
150 Posterior body member
151 Posterior body member first end
152 Posterior body member second end
153 Posterior body member side wall
155 Cap
156 Cap first end
157 Cap second end
160 Hand grip
170 Tool slot
180 Male adapter
181 Adapter first end
182 Adapter second end
200 Paint roller
201 Paint roller first end
202 Paint roller second end
203 Paint roller head
204 Paint roller handle
210 Paint roller handle extension
220 Paint can opener
230 Razor attachment
231 Razor first end

232 Razor second end
233 Razor blade
240 Scraper attachment
241 Scraper first end
242 Scraper second end
243 Scraper blade
250 Trim guide attachment
251 Trim guide first end
252 Trim guide second end
253 Trim guide blade Referring now to FIG. 1-8, the present invention features a paint roller and paint brush bag dispensing system (100) for conveniently providing storage for plastic bags used to preserve or cleanly dispose of paint roller covers and paint brushes. In some embodiments, the system (100) comprises a body (110) having a body first end (111), an opposing body second end (112), and a body cavity (113) disposed therein. In some embodiments, a bag slot (115) is disposed on a body side wall (114) and is fluidly connected to the body cavity (113). In some embodiments, a first male attachment (120) is disposed on the body first end (111) and a mated first female attachment (121) is disposed on the body second end (112).

In some embodiments, the system (100) comprises a roll of plastic bags (131) having a plurality of plastic bags (130) in series detachably disposed one to another. Sn some embodiments, the plastic bags (130) are connected by perforations. In some embodiments, the plastic bags are sized to fit a paint roller cover. In some embodiments, the roll of plastic bags (131) is disposed in the body cavity (113). In some embodiments, a roll of plastic bags first outer end (132) is disposed through and extends from the bag slot (115). In some embodiments, the roll of plastic bags first outer end (132) is designed for pulling a plastic bag (130) out and away from the body cavity (113) and detaching it from the roll of plastic bags (131) when needed for use. In some embodiments, once the paint brush or the paint roller cover is placed in the plastic bag (130), the end is tied with a draw string, a tie string, a twist tie, or sealed with an integrated closing means such as a mated bag sealing system.

Figure 8:
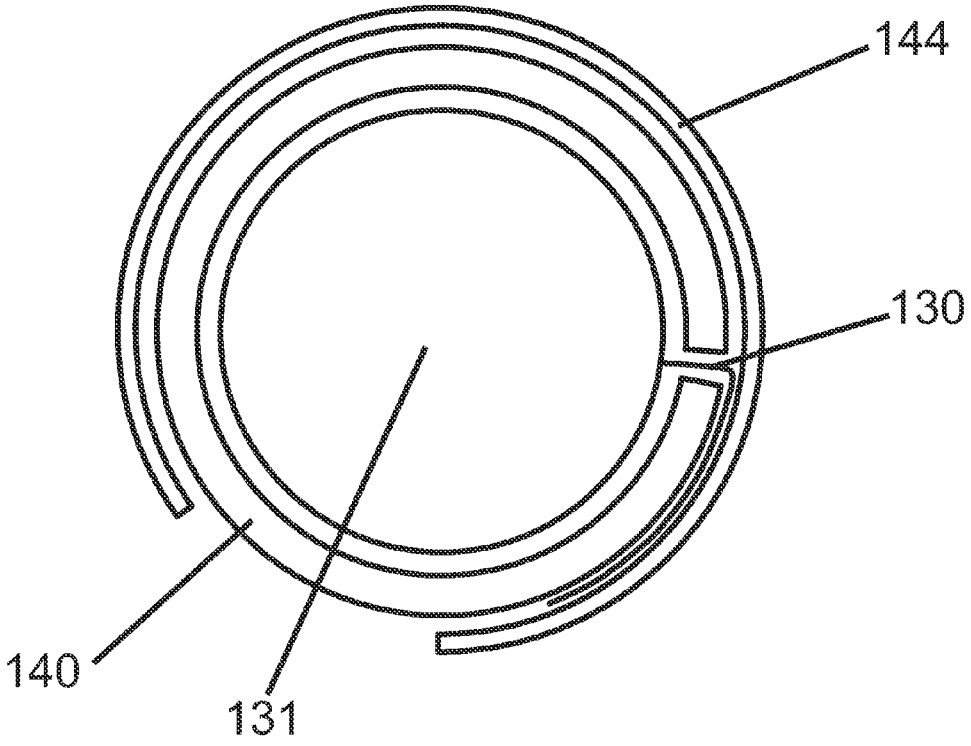
FIG. 8 shows a cross-sectional view of a thin plastic tubular component and the anterior body member.

In some embodiments, the plastic bag (130) can be a variety of colors or sizes to fit most paint rollers. In some embodiments, there is a thin plastic tubular component (144) that slides over the roll of plastic bags (131) inside the body cavity (113) to prevent them from sticking out from the bag slot (115). In some embodiments, there is a thin plastic tubular component (144) that wraps around the anterior body member (140). As seen in FIG. 8, the thin plastic tubular component (144) can be twisted around the anterior body member (140) in such a manner that will allow for the thin plastic tubular component (144) to cover the plastic bag (130) and seals the plastic bag (130) between the anterior body member (140) and the thin plastic tubular component (144). This will prevent the plastic bag (130) from sticking out. In some embodiments, the thin plastic tubular component (144) can be clear, transparent, colored, or have a patterned appearance.

In some embodiments, the first male attachment (120) is designed to attachably interface with a second female attachment (121) disposed on a paint roller handle (204). In some embodiments, the first female attachment (121) is designed to attachably interface with a second male attachment (120) disposed on a paint roller handle extension (210).

In some embodiments, the body (110) comprises an anterior body member (140) having an anterior body member first end (141) and an anterior body member second end (142). In some embodiments, the anterior body member (140) comprises the body cavity (113) and the bag slot (115) disposed therein. In some embodiments, the anterior body member (140) comprises the first male attachment (120) disposed on the anterior body member first end (141) thereon. In some embodiments, the body (110) further comprises a posterior body member (150) having a posterior body member first end (151) and a posterior body member second end (152). In some embodiments, the posterior body member (150), comprises the first female attachment (121) disposed on the posterior body member second end (152) thereon.

In some embodiments, the anterior body member second end (142) attachably connects to the posterior body member first end (151) forming the body (110). In some embodiments, the anterior body member second end (142) attachably connects to the posterior body member first end (151) via a rubber gasket.

In some embodiments, the posterior body member (150) comprises a hand grip (160) disposed on an exterior surface of the posterior body member side wall (153) thereon. In some embodiments, the hand grip (160) comprises ridges, indentions, grooves or projections.

In some embodiments, the system (100) comprises a cap (155) having a cap first end (156) and a cap second end (157). Sn some embodiments, the anterior body member second end (142) connects to the posterior body member first end (151) via the cap (155). In some embodiments, the anterior body member second end (142) threadably connects to mated threads disposed on the cap first end (156). In some embodiments, the cap second end (157) threadably connects to mated threads disposed on the posterior body member first end (151), In some embodiments, the system (100) comprises a paint can opener (220) removably disposed in a tool slot (170). In some embodiments, the too! slot (170) is centrally disposed on a terminating end of the body first end (111) on the first male attachment (120). In some embodiments, the paint can opener (220) is attached. In some embodiments, the paint can opener (220) is not attached.

In some embodiments, the system (100) comprises a male adapter (180) having an adapter first end (181) and an adapter second end (182). in some embodiments, the adapter first end (181) comprises a third male attachment (120) disposed thereon and the adapter second end (182) comprises a fourth male attachment (120) disposed thereon opposed to the third male attachment (120). In some embodiments, by using the male adapter (180), the body second end (112) is used for accessories in addition to the body first end (111).

In some embodiments, the system (100) comprises a razor attachment (230) having a razor first end (231) and a razor second end (232). In some embodiments, a razor blade (233) is removably disposed on the razor first end (231). In some embodiments, a third female attachment (121) is disposed in the razor second end (232). In some embodiments, the razor attachment (230) may be small, medium, or large. In some embodiments, the razor blade (233) is enclosed in a holding device. Sn some embodiments, the razor blade (233) is not enclosed in a holding device. In some embodiments, the razor blade (233) can be either screwed in or snapped into the neck of the stem.

In some embodiments the system (100) of claim 1 comprises a scraper attachment (240) having a scraper first end (241) and a scraper second end (242). In some embodiments, a scraper blade (243) is disposed on the scraper first end (241). In some embodiments, a fourth female attachment (121) is disposed in the scraper second end (242).

In some embodiments, the system (100) comprises a trim guide attachment (250) having a trim guide first end (251) and a trim guide second end (252). In some embodiments, a trim guide blade (253) is disposed on the trim guide first end (251). In some embodiments, a fifth female attachment (121) is disposed in the trim guide second end (252).

In some embodiments, the system (100) comprises a paint roller (200) having a paint roller first end (201) and a paint roller second end (202). In some embodiments, a paint roller head (203) is disposed on the paint roller first end (201). Sn some embodiments, the second female attachment (121) is disposed in the paint roller second end (202).

In some embodiments, the bag slot (115) is disposed proximal to an anterior body member midsection (143).

In some embodiments, the bag slot (115) is disposed adjacent to the anterior body member second end (142). In some embodiments, the bag slot (115) is fluidly open on a slot second end (116) adjacent to the body member second end (142) for sliding the plastic bag (130) pulled away from the roll of plastic bags (131) into the bag slot (115) via the open slot second end (116) when disposing the roll of plastic bags (131) into the body cavity (113).

In some embodiments, the system (100) comprises a paint roller (200) integrated into the body (110). In some embodiments, the body (110) becomes the paint roller handle (204) of the paint roller (200).

In some embodiments, the system (100) can come in mini, small, medium, and large sizes.

As used herein, the term "about" refers to plus or minus 10% of the referenced number.

The disclosures of the following U.S. patents are incorporated in their entirety by reference herein: U.S. Pat. No. 5,975,394.

Various modifications of the invention, in addition to those described herein, will be apparent to those skilled in the art from the foregoing description. Such modifications are also intended to fail within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of, and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

I claim:

1. A bag dispensing system, comprising:

a body having a body first end, an opposing body second end, and a body cavity disposed therein, wherein a bag slot is disposed on a body side wall and is fluidly connected to the body cavity, wherein a first male attachment is disposed on the body first end and a mated first female attachment is disposed on the body second end;

a roll of plastic bags having a plurality of plastic bags in series detachably disposed one to another, wherein the roll of plastic bags is disposed in the body cavity, wherein a first outer end of the roll of plastic bags is disposed through and extends from the bag slot, wherein the first outer end is designed for pulling the plastic bag out and away from the body cavity and detaching it from the roll of plastic bags when needed for use;

wherein the first male attachment is designed to attachably interface with a second female attachment disposed on a paint roller handle, wherein the first female attachment is designed to attachably interface with a second male attachment disposed on a paint roller handle extension;

a paint roller having a paint roller first end and a paint roller second end, wherein a paint roller head is disposed on the paint roller first end, wherein the second female attachment is disposed in the paint roller second end.

2. The system of claim 1, wherein the body further comprises an anterior body member having an anterior body member first end and an anterior body member second end, wherein the anterior body member comprises the body cavity and the bag slot disposed therein, wherein the anterior body member comprises the first male attachment disposed on the anterior body member first end thereon, wherein the body further comprises a posterior body member having a posterior body member first end and a posterior body member second end, wherein the posterior body member, comprises the first female attachment disposed on the posterior body member second end thereon; wherein the anterior body member second end attachably connects to the posterior body member first end forming the body.

3. The system of claim 2, wherein the posterior body member comprises a hand grip disposed on an exterior surface of a posterior body member side wall thereon.

4. The system of claim 2, further comprising a cap having a cap first end (156) and a cap second end, wherein the anterior body member second end connects to the posterior body member first end via the cap, wherein the anterior body member second end threadably connects to mated threads disposed on the cap first end, wherein the cap second end threadably connects to mated threads disposed on the posterior body member first end.

5. The system of claim 2, wherein the bag slot is disposed proximal to an anterior body member midsection.

6. The system of claim 2, wherein the bag slot is disposed adjacent to the anterior body member second end, wherein the bag slot is fluidly open on a slot second end adjacent to the body member second end for sliding the plastic bag pulled away from the roll of plastic bags into the bag slot via the open slot second end when disposing the roll of plastic bags into the body cavity.

7. The system of claim 1, further comprising a male adapter having an adapter first end and an adapter second end, wherein the adapter first end comprises a third male attachment disposed thereon and the adapter second end comprises a fourth male attachment disposed thereon opposed to the third male attachment.

8. A bag dispensing system, comprising:

a body having a body first end, an opposing body second end, and a body cavity disposed therein, wherein a bag slot is disposed on a body side wall and is fluidly connected to the body cavity, wherein a first male attachment is disposed on the body first end and a mated first female attachment is disposed on the body second end;

a roll of plastic bags having a plurality of plastic bags in series detachably disposed one to another, wherein the roll of plastic bags is disposed in the body cavity, wherein a first outer end of the roll of plastic bags is disposed through and extends from the bag slot, wherein the first outer end is designed for pulling the plastic bag out and away from the body cavity and detaching it from the roll of plastic bags when needed for use;

wherein the first female attachment is designed to attachably interface with a second male attachment disposed on a paint roller handle extension;

a paint can opener removably disposed in a tool slot, wherein the tool slot is centrally disposed on a terminating end of the body first end on the first male attachment.

9. A bag dispensing system, comprising:

a body having a body first end, an opposing body second end, and a body cavity disposed therein, wherein a bag slot is disposed on a body side wall and is fluidly connected to the body cavity, wherein a first male attachment is disposed on the body first end and a mated first female attachment is disposed on the body second end;

a roll of plastic bags having a plurality of plastic bags in series detachably disposed one to another, wherein the roll of plastic bags is disposed in the body cavity, wherein a first outer end of the roll of plastic bags is disposed through and extends from the bag slot, wherein the first outer end is designed for pulling the plastic bag out and away from the body cavity and detaching it from the roll of plastic bags when needed for use;

wherein the first female attachment is designed to attachably interface with a second male attachment disposed on a paint roller handle extension;

a razor attachment having a razor first end and a razor second end, wherein a razor blade is removably disposed on the razor first end, wherein a second female attachment is disposed in the razor second end and is connected to the first male attachment on the body first end.

10. A bag dispensing system, comprising:

a body having a body first end, an opposing body second end, and a body cavity disposed therein, wherein a bag slot is disposed on a body side wall and is fluidly connected to the body cavity, wherein a first male attachment is disposed on the body first end and a mated first female attachment is disposed on the body second end;

a roll of plastic bags having a plurality of plastic bags in series detachably disposed one to another, wherein the roll of plastic bags is disposed in the body cavity, wherein a first outer end of the roll of plastic bags is disposed through and extends from the bag slot, wherein the first outer end is designed for pulling the plastic bag out and away from the body cavity and detaching it from the roll of plastic bags when needed for use;

wherein the first female attachment is designed to attachably interface with a second male attachment disposed on a paint roller handle extension;

a scraper attachment having a scraper first end and a scraper second end, wherein a scraper blade is disposed on the scraper first end, wherein a second female attachment is disposed in the scraper second end and is connected to the first male attachment on the body first end.

11. A bag dispensing system, comprising:

a body having a body first end, an opposing body second end, and a body cavity disposed therein, wherein a bag slot is disposed on a body side wall and is fluidly connected to the body cavity, wherein a first male attachment is disposed on the body first end and a mated first female attachment is disposed on the body second end;

a roll of plastic bags having a plurality of plastic bags in series detachably disposed one to another, wherein the roll of plastic bags is disposed in the body cavity, wherein a first outer end of the roll of plastic bags is disposed through and extends from the bag slot, wherein the first outer end is designed for pulling the plastic bag out and away from the body cavity and detaching it from the roll of plastic bags when needed for use;

wherein the first female attachment is designed to attachably interface with a second male attachment disposed on a paint roller handle extension;

a trim guide attachment having a trim guide first end and a trim guide second end, wherein a trim guide blade is disposed on the trim guide first end, wherein a second female attachment is disposed in the trim guide second end and is connected to the first male attachment on the body first end.

* * * * *